US010675640B2

(12) United States Patent
Pogén

(10) Patent No.: US 10,675,640 B2
(45) Date of Patent: Jun. 9, 2020

(54) CENTRIFUGAL SEPARATOR WITH STACK OF ANGLED SEPARATION DISCS

(71) Applicant: ALFA LAVAL CORPORATE AB, Lund (SE)

(72) Inventor: Mats-Örjan Pogén, Billeberga (SE)

(73) Assignee: ALFA LAVAL CORPORATE AB, Lund (SE)

( * ) Notice: Subject to any disclaimer, the term of this patent is extended or adjusted under 35 U.S.C. 154(b) by 809 days.

(21) Appl. No.: 15/305,749

(22) PCT Filed: Apr. 23, 2015

(86) PCT No.: PCT/EP2015/058768

§ 371 (c)(1),
(2) Date: Oct. 21, 2016

(87) PCT Pub. No.: WO2015/172990

PCT Pub. Date: Nov. 19, 2015

(65) Prior Publication Data

US 2017/0072409 A1 Mar. 16, 2017

(30) Foreign Application Priority Data

May 13, 2014 (EP) ..... 14168110

(51) Int. Cl.
*B04B 5/08* (2006.01)
*B04B 7/14* (2006.01)
(Continued)

(52) U.S. Cl.
CPC ..... *B04B 5/08* (2013.01); *B04B 5/12* (2013.01); *B04B 7/14* (2013.01); *B04B 11/02* (2013.01);
(Continued)

(58) Field of Classification Search
CPC .. B04B 5/08; B04B 11/02; B04B 7/14; B04B 5/12; B04B 2005/125; F01M 13/04; F01M 2013/0422; B21D 22/16
(Continued)

(56) References Cited

U.S. PATENT DOCUMENTS 2,665,843 A 1/1954 Staaf
4,325,825 A 4/1982 Schütte
(Continued)

FOREIGN PATENT DOCUMENTS

CN 101171087 A 4/2008
CN 102227266 A 10/2011
(Continued)

OTHER PUBLICATIONS

English translation of the Russian Office Action and Search Report for Application No. 2016148421, dated Mar. 6, 2018.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator is configured for cleaning of crankcase gases from an internal combustion engine. The centrifugal separator includes a rotor rotatably arranged inside a stationary housing. The stationary housing includes an inlet for crankcase gases, a gas outlet, and a liquid outlet. The rotor includes a stack of separation discs, each separation disc of the stack of separation discs having a center axis, an inner surface, and an outer surface. A circumferential inner end surface extends between the inner surface and the outer surface. The circumferential inner end surface of at least one separation disc of the stack of separation discs
(Continued)

includes a substantially flat first surface portion extending at an angle of at least 20 degrees to the center axis.

20 Claims, 3 Drawing Sheets

(51) Int. Cl.
*B04B 5/12* (2006.01)
*B04B 11/02* (2006.01)
*F01M 13/04* (2006.01)

(52) U.S. Cl.
CPC ..... *F01M 13/04* (2013.01); *B04B 2005/125* (2013.01); *F01M 2013/0422* (2013.01)

(58) Field of Classification Search
USPC ..... 95/1, 270; 55/406; 96/397, 423; 494/67, 68, 70
See application file for complete search history.

(56) References Cited

U.S. PATENT DOCUMENTS

| | | | | |
|---|---|---|---|---|
| 7,875,098 | B2 * | 1/2011 | Hallgren | B01D 45/14 55/406 |
| 2004/0214710 | A1 | 10/2004 | Herman et al. | |
| 2007/0066476 | A1 | 3/2007 | Ullmann et al. | |
| 2009/0025562 | A1 | 1/2009 | Hallgren et al. | |
| 2009/0266231 | A1 | 10/2009 | Franzen et al. | |
| 2010/0011723 | A1 * | 1/2010 | Szepessy | B01D 45/14 55/438 |
| 2011/0237417 | A1 | 9/2011 | Rudman et al. | |
| 2014/0083954 | A1 | 3/2014 | König et al. | |
| 2014/0148327 | A1 * | 5/2014 | Nilsson | B21D 22/16 494/70 |
| 2014/0221187 | A1 | 8/2014 | König et al. | |

FOREIGN PATENT DOCUMENTS

| | | | | |
|---|---|---|---|---|
| CN | 103547374 | A | 1/2014 | |
| DE | 102010052301 | A1 | 5/2012 | |
| EP | 1 661 626 | A1 | 5/2006 | |
| EP | 1661626 | A1 * | 5/2006 | B04B 5/005 |
| EP | 2 556 895 | A1 | 2/2013 | |
| JP | 11-506385 | A | 6/1999 | |
| JP | 2005-515065 | A | 5/2005 | |
| JP | 2008-502473 | A | 1/2008 | |
| JP | 2014-547 | A | 1/2014 | |
| RU | 2445170 | C2 | 3/2012 | |
| WO | WO 96/27445 | A1 | 9/1996 | |
| WO | WO 03/061838 | A1 | 7/2003 | |
| WO | WO 2005/005050 | A1 | 1/2005 | |
| WO | WO 2005/123220 | A1 | 12/2005 | |
| WO | WO 2007/114766 | A1 | 10/2007 | |
| WO | WO-2007114766 | A1 * | 10/2007 | B04B 1/08 |
| WO | WO 2013/067245 | A1 | 5/2013 | |

OTHER PUBLICATIONS

Japanese Notice of Reasons for Refusal for Japanese Application No. 2016-567519, dated Jan. 5, 2018, with Translation.
European Office Action dated Nov. 8, 2017, for corresponding European Application No. 14168110.6.
Chinese Office Action and Search Report for Chinese Application No. 201580024869.2, dated May 28, 2018, with English translation.
English translation of a Korean Office Action for Korean Application No. 10-2016-7034418, dated Jun. 14, 2018.

* cited by examiner

CENTRIFUGAL SEPARATOR WITH STACK OF ANGLED SEPARATION DISCS

TECHNICAL FIELD

The present invention relates to a centrifugal separator for cleaning of crankcase gases from an internal combustion engine.

BACKGROUND

Crankcase gases from an internal combustion engine are ventilated from a crankcase of a relevant combustion engine. Crankcase gases may be dealt with in an environmentally friendly manner instead of being ventilated into the atmosphere. There are in some jurisdictions regulatory requirements that do not allow crankcase gases from certain types of combustion engines to be ventilated to the atmosphere.

Crankcase gases may comprise inter alia blow-by gases, oil, other liquid hydrocarbons, soot, and other solid combustion residues. In order to dispose of crankcase gases suitably, the gas is separated from oil, soot, and other residues. The separated gas may be led to an air intake of the combustion engine and the oil may be led back to an oil trough of the combustion engine, e.g. via an oil filter for removing soot and other solid residues from the oil.

U.S. Pat. No. 7,875,098 discloses a centrifugal separator for cleaning of crankcase gases. The centrifugal separator comprises a stationary casing defining an inner space, a spindle and a rotating member, which is attached to the spindle and arranged to rotate around an axis of rotation. The rotating member comprises a number of truncated conical separating discs which are provided in the inner space.

Separating discs, or separation discs, of a centrifugal separator are arranged in a disc stack with small interspaces between the separation discs. In the case of separation of crankcase gases, heavy constituents of the crankcase gases, such as oil and soot, are forced against inner surfaces of the separation discs and form droplets as they travel along the separation discs towards an outer periphery of the disc stack. The droplets are flung onto an inner wall of a housing of the centrifugal separator and are led out of the centrifugal separator via an oil outlet. The cleaned crankcase gases are led out of the centrifugal separator via a gas outlet.

The small interspaces between the separation discs in the disc stack of a centrifugal separator for crankcase gases may be blocked under certain circumstances, when a lot of soot and sticky particles is produced in a combustion engine e.g. due to high EGR (Exhaust Gas Recirculation) or due to a relevant combustion engine being worn. In particular, at the inner circumference of the separation discs, soot and/or other solid combustion residues may accumulate together with oil and/or other hydrocarbons. Entrance of the combustion gases into the interspaces between the separation discs in the disc stack thus, may be impeded. Accordingly, separation performance of the centrifugal separator may be reduced.

SUMMARY

It is an object of the present invention to prevent accumulation of soot and other solid combustion residues at an inner circumference of separation discs of a centrifugal separator for cleaning crankcase gases.

According to an aspect of the invention, the object is achieved by a centrifugal separator configured for cleaning of crankcase gases from an internal combustion engine, the centrifugal separator comprising a stationary housing and a rotor rotatably arranged inside the stationary housing. The stationary housing comprises an inlet for crankcase gases, a gas outlet, and a liquid outlet. The rotor comprises a stack of separation discs, each separation disc of the stack of separation discs having a centre axis and a truncated conical shape comprising an inner surface and an outer surface. A circumferential inner end surface extends between the inner surface and the outer surface. The circumferential inner end surface of at least one separation disc of the stack of separation discs comprises a substantially flat first surface portion extending at an angle of at least 20 degrees to the centre axis.

Further, the stack of separation discs is arranged such that the circumferential inner end surface is upstream of the interspaces formed between the discs in the disc stack. This means that crankcase gas being fed to the separator meets the circumferential inner end surface before being led between the discs in the disc stack.

Since the first surface portion of the circumferential inner end surface of at least one separation disc extends at a surface angle of at least 20 degrees to the centre axis, a surface parallel with the centre axis, i.e. a surface perpendicular to the centrifugal forces acting on the crankcase gases in the centrifugal separator, is avoided.

Accordingly, soot and other solid combustion residues together with oil and/or other hydrocarbons will slide along the first surface portion into an adjacent separation disc interspace. As a result, the above mentioned object is achieved.

It has been found by the inventor that providing a circumferential inner end surface of a separation disc at an angle to the centre axis of the separation disc will prevent build-up of soot and other solid combustion residues on the inner end surface. Due to the angled inner end surface and the centrifugal force acting on the oil and other hydrocarbons mixed with the soot and other solid combustion residues, the oil and other hydrocarbons mixed with the soot and other solid combustion residues on the inner end surface will slide along the inner end surface into an interspace between the separation discs.

According to embodiments, the substantially flat first surface portion extends at an angle of at least 30 degrees to the centre axis, such as at an angle of at least 45 degrees to the centre axis, such as at an angle of at least 60 degrees to the centre axis, such as at an angle of at least 75 degrees to the centre axis.

The internal combustion engine may be configured for propelling a vehicle or may be a stationary combustion engine, for instance for driving a generator for generating electric energy. The centrifugal separator is configured to separate heavy constituents of the crankcase gases, such as oil, other hydrocarbons, soot, and other solid combustion residues from gases of the crankcase gases, such as combustions gases and air. Between the separation discs in the disc stack, interspaces are formed. The crankcase gases enter the interspaces from a central portion of the disc stack. As the rotor rotates with the disc stack, the heavy constituents are forced against the inner surfaces of the separation discs and travel, normally in the form of droplets, along the separation discs towards an outer periphery of the disc stack. From the disc stack the droplets are propelled against an inner wall of the stationary housing. The droplets accumulate on the inner wall and are led out of the centrifugal separator via the liquid outlet. The cleaned crankcase gases are led out of the centrifugal separator via the gas outlet.

According to embodiments, a cone angle of the at least one separation disc is defined between the centre axis and the inner surface of the at least one separation disc. The angle extending between the centre axis and the first surface portion may point in a direction opposite to the cone angle. In this manner the oil and other hydrocarbons mixed with the soot and other solid combustion residues on the inner end surface will slide along the inner end surface towards the outer surface of the at least one separation disc and into the interspace between the separation discs According to embodiments, an edge having a maximum radius of 0.15 mm may be formed at a radially inner perimeter of the at least one separation disc at a transition between the first surface portion and the inner surface or the outer surface. In this manner any substantial surface portion at the inner periphery of the at least one separation disc extending in parallel with the centre axis may be avoided.

According to embodiments, the separation discs of the stack of separation discs may be manufactured from an injection mouldable plastic material. In this manner the separation discs may be cost efficiently produced by injection moulding.

According to embodiments, the at least one separation disc may comprise a circumferential outer end surface extending between the inner surface and the outer surface. The disc in the disc stack may be arranged such that the circumferential outer end surface is downstream and radially outside the circumferential inner end surface. The circumferential outer end surface may comprise a substantially flat second surface portion extending substantially in parallel with the centre axis. In this manner a larger disc area on the inner side of the at least one separation disc may be provided than if the outer end surface would extend substantially at a right angle to the centre axis. Thus, a larger separation area may be provided.

According to embodiments, the outer surface of the at least one separation disc may be provided with distance elements configured to abut against the inner surface of an adjacent separation disc and configured to provide a distance between the at least one separation disc and the adjacent separation disc in the stack of separation discs. In this manner consistent interspaces between adjacent separation discs may be provided.

According to embodiments, the centrifugal separator may be configured to lead crankcase gases from the inlet into a central portion of the rotor. In this manner the crankcase gases may be "pumped" from the central portion of the rotor into the interspaces between the separation discs in the stack of separation discs by the rotation of the rotor. Thus, the centrifugal separator may work according to the concurrent flow principle, in which the gas flows in the disc stack from a radial inner part to a radial outer part, which is opposite to a separator operating according to the counter-current flow principle, in which the gas is conducted into the centrifugal rotor at the periphery of the rotor and is led towards a central part of the rotor.

According to embodiments, the rotor may comprise a spindle, and the centrifugal separator may comprise a drive arrangement configured to rotate the spindle. In this manner the rotor may be rotated. Examples of a suitable drive arrangement are an electric motor, a pneumatic motor, a hydraulic motor, a turbine driven by crankcase gas, oil or other liquid, or a gear arrangement connected to a suitable rotating part such as a camshaft, a pump, or a fan.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
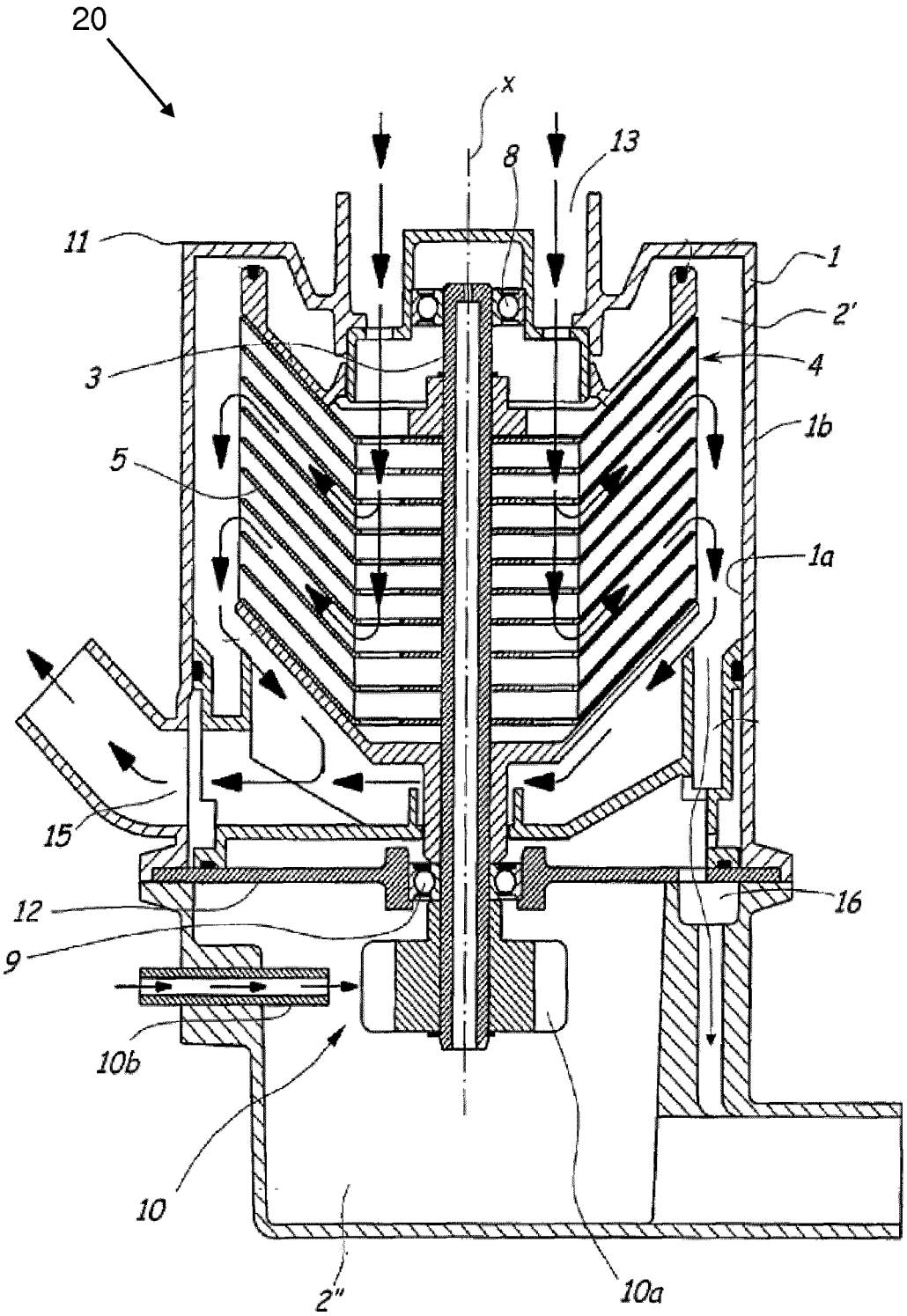
FIG. 1 illustrates a cross section through a centrifugal separator according to embodiments, and FIGS. 2*a*-2*c* each illustrates a cross section through a portion of a stack of separation discs according to embodiments.

FIG. 1 illustrates a cross section through a centrifugal separator 20 according to embodiments. The centrifugal separator 20 is configured for cleaning of crankcase gases coming from an internal combustion engine. The centrifugal separator 20 comprises a stationary housing 1 and a rotor 4 rotatably arranged inside the stationary housing 1. The stationary housing 1 defines an inner space 2'. The stationary housing 1 has an inner wall surface 1*a*, which faces the inner space 2' and an outer wall surface 1*b* which faces outwardly towards an ambient environment of the centrifugal separator 20. The stationary housing 1 comprises an inlet 13 for crankcase gases, a gas outlet 15 for cleaned gas, and a liquid outlet 16 for heavy constituents of the crankcase gases such as oil and soot. The inner space 2' has an upper end 11 and a lower end 12. The inlet 13 for crankcase gases extends through the casing 1 at the upper end 11 into the inner space 2'. In these embodiments, the gas outlet 15 and the liquid outlet 16 are provided at the proximity of the lower end 12.

The rotor 4 comprises a stack of separation discs 5. Each separation disc 5 of the stack of separation discs has a centre axis x and a truncated conical shape comprising an inner surface and an outer surface, see below with reference to FIGS. 2*a*-2*c*. The rotor 4 comprises a spindle 3. The spindle 3 is journaled in two bearings, an upper spindle bearing 8 and a lower spindle bearing 9. The centrifugal separator 20 comprises a drive arrangement 10 configured to rotate the spindle 3. The drive arrangement 10 in these embodiments is provided in a separate space 2" below the inner space 2'. The drive arrangement 10 comprises a turbine 10*a* which is driven by oil from a relevant combustion engine. Thus, the rotor 4 is brought to rotate in the inner space 2'. The present invention is not limited to the drive arrangement 10 illustrated in FIG. 1 but may be any suitable drive arrangement, as discussed above.

The crankcase gases to be cleaned are fed into the centrifugal separator 20 through the inlet 13. The centrifugal separator 20 is configured to lead crankcase gases from the inlet 13 into a central portion of the rotor 4. From the central portion, the crankcase gases are led into interspaces between the separation discs 5. When the crankcase gases arrive in the inner space 2' and is brought to rotate by the rotor 4, the heavy constituents will abut against the separation discs 5 and by means of the centrifugal force will be thrown from an outer periphery of the rotor 4 against the inner wall surface 1*a* of the stationary housing 1. The gas, which in such a way has been cleaned and thus been substantially completely relieved from the heavy constituents, is then conveyed downwardly in the inner space 2' and out through the gas outlet 15. The heavy constituents flow on the inner wall surface 1*a* down into an annular collection groove 17 and out through the liquid outlet 16.

Figure 2A:
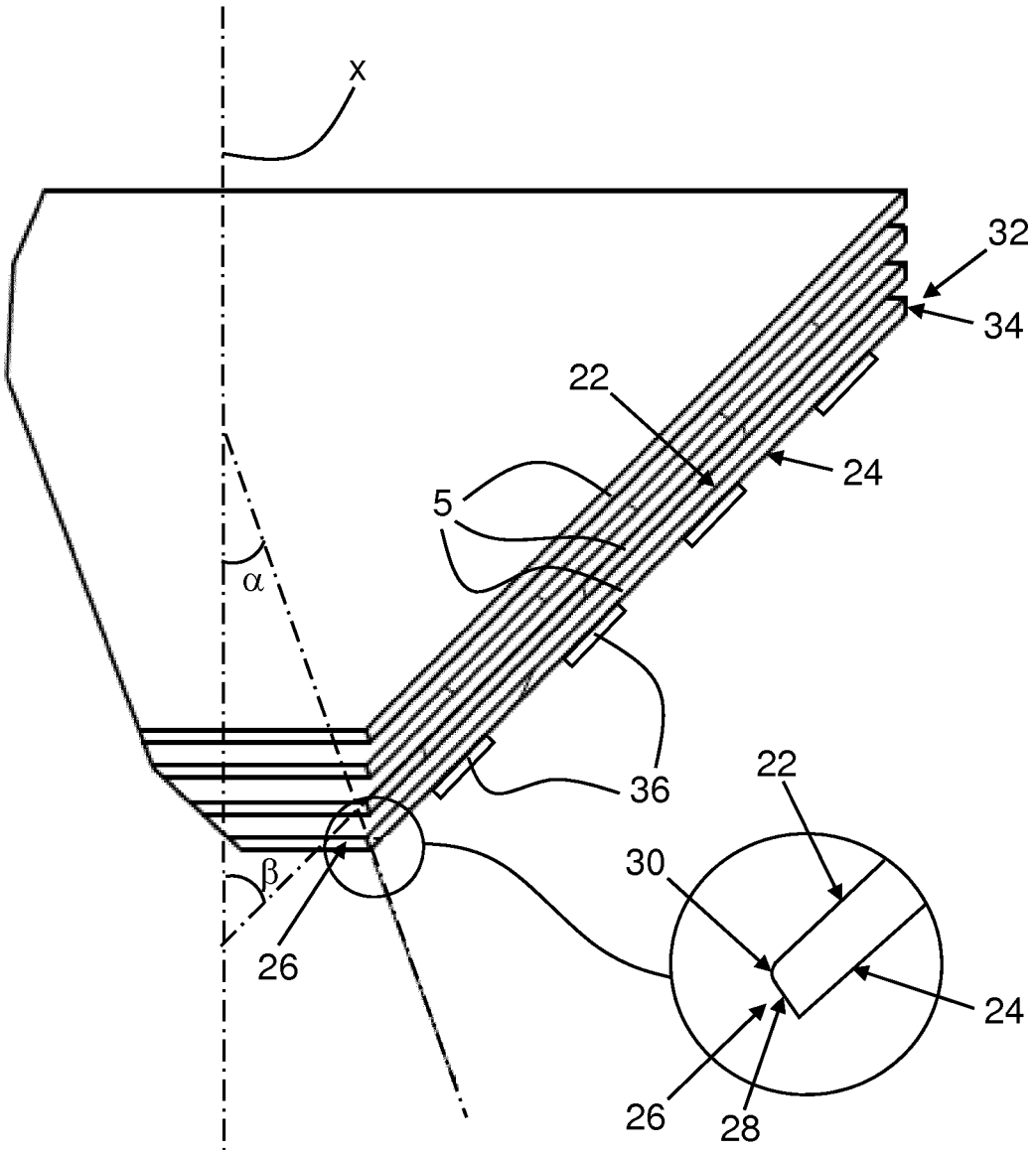

FIG. 2*a* illustrates a cross section through a portion of a stack of separation discs 5 according to embodiments. The portion of the stack of separation discs 5 is configured to form part of a rotor 4 of a centrifugal separator configured for cleaning of crankcase gases coming from an internal combustion engine. A full stack of separation disc of such a centrifugal separator may for instance comprise 20-150 separation discs. Mentioned purely as an example, a separation disc 5 may have a diameter of approximately 100 mm, a thickness of approximately 0.35 mm (not including any distance elements), and interspaces between adjacent separation discs 5 may be approximately 0.3 mm. Each separation disc 5 of the stack of separation discs has a centre axis x and a truncated conical shape comprising an inner surface 22 and an outer surface 24. Interspaces are formed between the inner surfaces 22 and outer surfaces 24 of adjacent discs.

A circumferential inner end surface 26 extends between the inner surface 22 and the outer surface 24. The circumferential inner end surface (26) is upstream of the interspaces formed between the discs in the disc stack (5). The circumferential inner end surface 26 of at least one separation disc 5 of the stack of separation discs comprises a substantially flat first surface portion 28 extending at an angle α of at least 20 degrees to the centre axis x. Thus, the first surface portion 28 is not parallel with the centre axis x and thus, soot and other particles will not build up on the inner surface 26 since they will slide along the inner surface portion into the interspaces between the separation discs 5. The circumferential inner end surface 26 of each of the separation discs 5 of the stack of separation discs may comprise a substantially flat first surface portion 28 extending at an angle α of at least 20 degrees to the centre axis x.

A cone angle β of the at least one separation disc 5 is defined between the centre axis x and the inner surface 22 of the at least one separation disc 5. The angle α extending between the centre axis x and the first surface portion 28 points in a direction opposite to the cone angle β. In alternative embodiments the cone angle β may point in the same direction as the angle α extending between the centre axis x and the first surface portion 28. Obviously, in such embodiments the angle α has to be smaller than the cone angle β. In these embodiments the cone angle β is approximately 45 degrees. In alternative embodiments the cone angle β may be smaller or larger.

An edge 30 having a maximum radius of 0.15 mm is formed at a radially inner perimeter of the at least one separation disc 5 at a transition between the first surface portion 28 and the inner surface 22. In the alternative embodiments discussed above, with angles α, β pointing in the same direction, the edge 30 having a maximum radius of 0.15 mm is instead formed at a radially inner perimeter of the at least one separation disc 5 at a transition between the first surface portion 30 and the outer surface 24. The edge 30 may have a substantially smaller radius than 0.15 mm. The edge 30 may even be substantially sharp.

The at least one separation disc 5 comprise a circumferential outer end surface 32 extending between the inner surface 22 and the outer surface 24 of the at least one separation disc 5. The circumferential outer end surface 32 comprises a substantially flat second surface portion 34 extending substantially in parallel with the centre axis x. The circumferential outer end surface 26 of each of the separation discs 5 of the stack of separation discs may comprise a substantially flat second surface portion 34 extending substantially in parallel with the centre axis x. Besides the above discussed provision of a larger separation area, the substantially flat second surface portion 34 extending substantially in parallel with the centre axis x also provides advantages when producing separation discs 5 by injection moulding.

Accordingly, the separation discs 5 may be manufactured from an injection mouldable plastic material, such as Polyamid66 (PA66), polypropylene, or other suitable material. The separation discs 5 may comprise a fibrous material, such as glass fibre, in the plastic material. When manufacturing separation discs 5 by injection moulding, the plastic material is injected into a die formed by a female half and a male half. In order to ensure reliable production of separation discs, it is imperative that every moulded separation disc remains in the same half of the die when the two halves are separated. The substantially flat second surface portion 34 extending substantially in parallel with the centre axis x of a separation disc 5 is formed in the female half of the die. The extension of the second surface portion may ensure that each separation disc remains in the female half of the die, when the female and male halves of the die are separated.

The outer surface 24 of the at least one separation disc 5 is provided with distance elements 36 configured to abut against the inner surface 22 of an adjacent separation disc 5 in the disc stack. Each separation disc 5 in the stack of separation discs may be provided with such distance elements 36 (not shown in FIG. 2*a*) to provide consistent interspaces between adjacent separation discs 5 in the stack. The distance elements 36 may for instance have a rectangular, square, round, or oval shape. Besides ensuring interspaces between the separation discs 5, the distance elements 36 also provide advantages when producing separation discs 5 by injection moulding. Since the distance elements 36 are provided on the outer surface 24, the distance elements 36 will be formed in the female half of the die. Accordingly, the distance elements 36 may engage with the female half and may ensure that each separation disc 5 remains in the female half when the female and male halves of the die are separated.

Figure 2B:
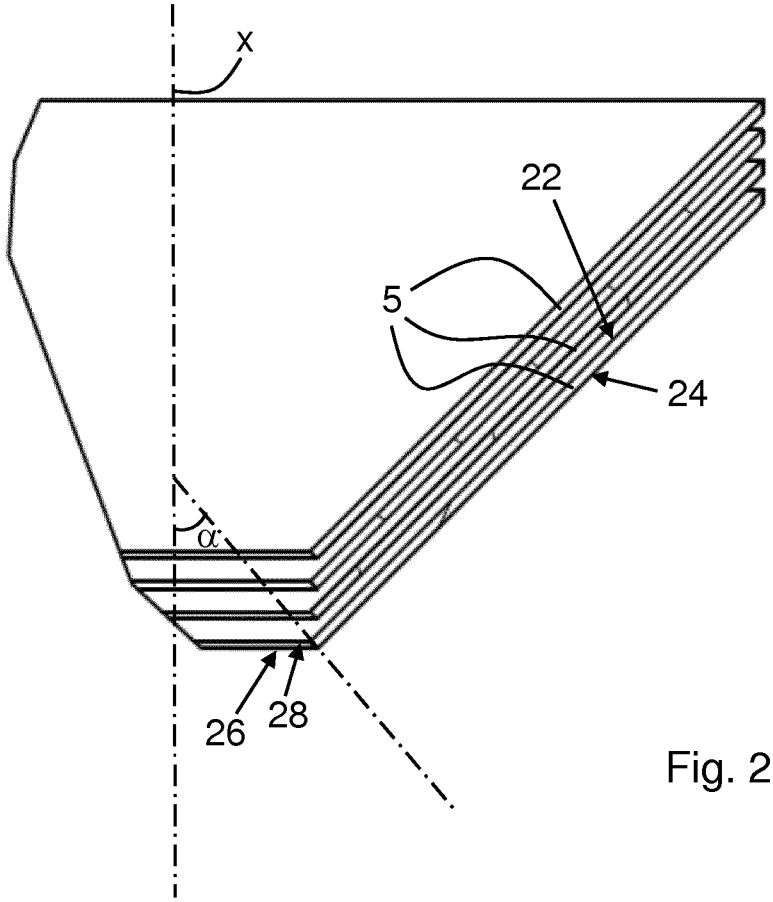
Figure 2C:
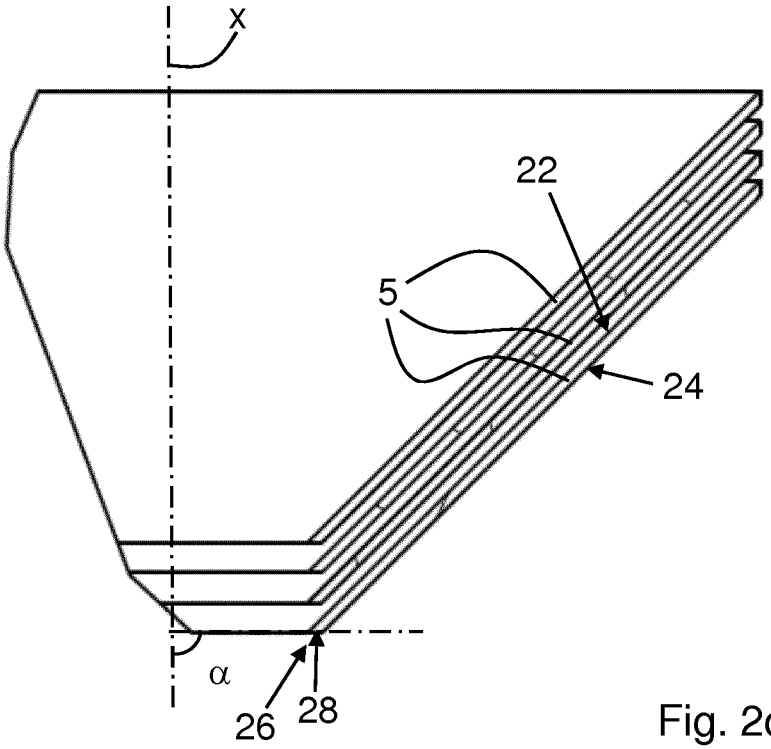

FIGS. 2*b* and 2*c* each illustrates a cross section through a portion of a stack of separation discs 5 according to embodiments. Again, the portion of the stack of separation discs 5 is configured to form part of a rotor of a centrifugal separator configured for cleaning of crankcase gases. The separation discs 5 of these embodiments resemble in much the separation discs 5 of the embodiments discussed in connection with FIG. 2*a*. Again, a circumferential inner end surface 26 extends between an inner surface 22 and an outer surface 24 of each separation disc 5. The circumferential inner end surface 26 of at least one separation disc 5 of the stack of separation discs comprises a substantially flat first surface portion 28 extending at an angle α to the centre axis x.

The main differences with the embodiments of FIG. 2*a* will be discussed below.

In the embodiment of FIG. 2*b*, the first surface portion 28 extends at an angle α of at least 45 degrees to the centre axis x. A steeper angel α may thus per provided than in the embodiments of FIG. 2*a*. In this manner the soot and other combustions residues may be even less prone to build up at the inner circumferences of the separation discs 5.

In the embodiments of FIG. 2*c*, the first surface portion 28 extends substantially perpendicularly to the centre axis x. That is, the angle α is substantially 90 degrees. In this manner substantially no surface portion of the circumferential inner end surface 26 extending between the inner and outer surfaces 22, 24 along the centre axis x. Thus, a surface at which soot and other combustion residues could build up is not provided in these embodiments.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims. The separation discs 5 alternatively, may be manufactured from sheet metal, such as aluminium.

Although the invention has been described with reference to example embodiments, many different alterations, modifications and the like will become apparent for those skilled in the art. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A centrifugal separator configured for cleaning of crankcase gases from an internal combustion engine, the centrifugal separator comprising:

a stationary housing; and a rotor rotatably arranged inside the stationary housing, wherein the stationary housing comprises:

an inlet for crankcase gases;

a gas outlet; and a liquid outlet, wherein the rotor comprises a stack of separation discs with interspaces formed therebetween, each separation disc of the stack of separation discs having a center axis and a truncated conical shape comprising a first surface, a second surface opposite to and parallel with the first surface, and a circumferential inner end surface positioned in the vicinity of the center axis and extending between the first surface and the second surface, wherein the inlet for crankcase gases is positioned radially inward of the gas outlet with respect to the center axis, wherein the stack of separation discs is arranged such that the circumferential inner end surface is upstream of the interspaces formed between the separation discs in the stack of separation discs, and wherein the circumferential inner end surface of at least one separation disc of the stack of separation discs comprises a substantially flat first surface portion extending at an angle of at least 20 degrees to the center axis.

2. The centrifugal separator according to claim 1, wherein the first surface portion extends at an angle of at least 45 degrees to the center axis.

3. The centrifugal separator according to claim 1, wherein a cone angle of the at least one separation disc is defined between the center axis and the first surface of the at least one separation disc, and wherein the angle extending between the center axis and the first surface portion points in a direction opposite to the cone angle.

4. The centrifugal separator according to claim 1, wherein the first surface portion extends substantially perpendicularly to the center axis.

5. The centrifugal separator according to claim 1, wherein an edge having a maximum radius of 0.15 mm is formed at a radially inner perimeter of the at least one separation disc at a transition between the first surface portion and the first surface or the second surface.

6. The centrifugal separator according to claim 1, wherein the separation discs of the stack of separation discs are manufactured from an injection moldable plastic material.

7. The centrifugal separator according to claim 1, wherein the at least one separation disc comprises a circumferential outer end surface extending between the first surface and the second surface, and wherein the circumferential outer end surface comprises a substantially flat second surface portion extending substantially in parallel with the center axis.

8. The centrifugal separator according to claim 1, wherein the second surface of the at least one separation disc is provided with distance elements configured to abut against the first surface of an adjacent separation disc and configured to provide a distance between the at least one separation disc and the adjacent separation disc in the stack of separation discs.

9. The centrifugal separator according to claim 1, being configured to lead crankcase gases from the inlet into a central portion of the rotor.

10. The centrifugal separator according to claim 1, wherein the rotor comprises a spindle, and wherein the centrifugal separator comprises a drive arrangement configured to rotate the spindle.

11. The centrifugal separator according to claim 2, wherein a cone angle of the at least one separation disc is defined between the center axis and the first surface of the at least one separation disc, and wherein the angle extending between the center axis and the first surface portion points in a direction opposite to the cone angle.

12. The centrifugal separator according to claim 2, wherein the first surface portion extends substantially perpendicularly to the center axis.

13. The centrifugal separator according to claim 3, wherein the first surface portion extends substantially perpendicularly to the center axis.

14. The centrifugal separator according claim 2, wherein an edge having a maximum radius of 0.15 mm is formed at a radially inner perimeter of the at least one separation disc at a transition between the first surface portion and the first surface or the second surface.

15. The centrifugal separator according to claim 3, wherein an edge having a maximum radius of 0.15 mm is formed at a radially inner perimeter of the at least one separation disc at a transition between the first surface portion and the first surface or the second surface.

16. The centrifugal separator according to claim 4, wherein an edge having a maximum radius of 0.15 mm is formed at a radially inner perimeter of the at least one separation disc at a transition between the first surface portion and the first surface or the second surface.

17. The centrifugal separator according to claim 2, wherein the separation discs of the stack of separation discs are manufactured from an injection moldable plastic material.

18. The centrifugal separator according to claim 3, wherein the separation discs of the stack of separation discs are manufactured from an injection moldable plastic material.

19. The centrifugal separator according to claim 4, wherein the separation discs of the stack of separation discs are manufactured from an injection moldable plastic material.

20. The centrifugal separator according to claim 5, wherein the separation discs of the stack of separation discs are manufactured from an injection moldable plastic material.

* * * * *